US009595793B2

(12) United States Patent
Masunaga

(10) Patent No.: US 9,595,793 B2
(45) Date of Patent: Mar. 14, 2017

(54) ELECTRIC CONNECTOR HAVING A RETAINING MEMBER WITH A COVER IN ELECTRICAL CONTACT WITH A SHELL OF A MATING CONNECTOR

(71) Applicant: DAI-ICHI SEIKO CO., LTD., Kyoto-shi (JP)

(72) Inventor: Takashi Masunaga, Fukuoka (JP)

(73) Assignee: DAI-ICHI SEIKO CO., LTD., Kyoto-shi (JP)

( * ) Notice: Subject to any disclaimer, the term of this patent is extended or adjusted under 35 U.S.C. 154(b) by 0 days.

(21) Appl. No.: 15/098,721

(22) Filed: Apr. 14, 2016

(65) Prior Publication Data

US 2016/0308308 A1 Oct. 20, 2016

(30) Foreign Application Priority Data

Apr. 17, 2015 (JP) ..... 2015-085439

(51) Int. Cl.
*H01R 13/627* (2006.01)
*H01R 13/648* (2006.01)
(Continued)

(52) U.S. Cl.
CPC ..... *H01R 13/6581* (2013.01); *H01R 12/7005* (2013.01); *H01R 13/6275* (2013.01); *H01R 13/639* (2013.01); *H01R 13/6593* (2013.01)

(58) Field of Classification Search
USPC ..... 439/78, 331, 352, 355, 358, 607.04, 439/607.23, 607.27
See application file for complete search history.

(56) References Cited

U.S. PATENT DOCUMENTS

2004/0175982 A1* 9/2004 Kuroda ..... H01R 13/6275 439/358
2008/0032526 A1* 2/2008 Takahashi ..... H01R 4/5066 439/81

(Continued)

FOREIGN PATENT DOCUMENTS

JP 2002-170640 A 6/2002
JP 2007-73426 3/2007
JP 2011-238410 11/2011

*Primary Examiner* — Chandrika Prasad
(74) *Attorney, Agent, or Firm* — Oblon, McClelland, Maier & Neustadt, L.L.P.

(57) ABSTRACT

Electromagnetic shielding about a part connected with a wiring board is easily and reliably carried out by a simple configuration. An electrically-conductive cover member provided at a mating retaining member of both of electric connectors is provided with a cover contact-point part contacting an electrically-conductive shell of a counterpart connector when the mating retaining member is subjected to a turning operation, and the electrically-conductive cover member is subjected to the turning operation together with the mating retaining member, thereby covering the connection part of the counterpart connector mounted on a wiring board and the wiring board by the electrically-conductive cover member, carrying out electromagnetic shielding with respect to the part connected with the wiring board; and, by forming a ground circuit by grounding the electrically-conductive cover member through the cover contact-point part of the electrically-conductive cover member and the electrically-conductive shell, further good electromagnetic shielding characteristics (shield characteristics) are configured to be obtained.

16 Claims, 10 Drawing Sheets

FIG.1

(51) Int. Cl.

| | |
|---|---|
| ***H01R 13/6581*** | (2011.01) |
| ***H01R 12/70*** | (2011.01) |
| ***H01R 13/639*** | (2006.01) |
| ***H01R 13/6593*** | (2011.01) |

(56) References Cited

U.S. PATENT DOCUMENTS

2009/0208168 A1* 8/2009 Ishikawa ..... H01R 13/113
385/14
2012/0252252 A1* 10/2012 Yamaji ..... H01R 13/6581
439/310

* cited by examiner

ELECTRIC CONNECTOR HAVING A RETAINING MEMBER WITH A COVER IN ELECTRICAL CONTACT WITH A SHELL OF A MATING CONNECTOR

BACKGROUND OF THE INVENTION

Field of the Invention

The present invention relates to an electric connector and an electric connector device configured to cover the part connected with a wiring board by an electrically-conductive cover member provided on a mating retaining member, which is subjected to a turning operation so as to maintain a mated state.

Description of Related Art

Generally in various electric equipment, etc., connecting various signal transmission media composed of FPC (flexible printed circuits), FFC (flexible flat cables), coaxial cables, or the like to a printed wiring board by using an electric connector device is widely carried out. The electric connector device like this is configured to, for example, mutually mate both electric connectors so that a plug connector coupled to signal transmission media such as coaxial cables is inserted in a receptacle connector mounted on a printed wiring board. In the case of mutual mating of both of the electric connectors, for example, a configuration in which the mutually mated state of both of the connectors is retained by subjecting an operation-lever-shaped mating retaining member provided in the plug connector to a turning operation so as to latch it with the receptacle-connector side is often employed.

On the other hand, in the electric connector device like this provided with the mating retaining member (mating operating lever), which retains the mutually mated state of both of the connectors, conventionally, in order to reduce the influence of electromagnetic wave noise from outside with respect to transmission signals and to reduce electromagnetic wave noise radiated toward the outside, a configuration in which electromagnetic shielding (shield) is carried out by covering the outer surface of a connector main-body part (insulating housing) and the outer side of a contact member by an electrically-conductive shell or a shield plate composed of a thin-plate-shaped metal member is often employed. Furthermore, for example, in below described Patent Document 2, etc., the mating retaining member (operation lever) is provided with an electrically-conductive cover member.

In more detail, when the mating retaining member (mating operating lever) is turned to a mating working position, the electrically-conductive cover member is configured to cover the connection part of electrically-conductive contacts of the counterpart connector (receptacle connector) and the wiring board. When such a configuration is employed, electromagnetic shielding (shield) with respect to the part of the electrically-conductive contacts connected to the wiring board is carried out when both of the connectors are mated, increase of manufacturing steps is prevented, and the connection state at the wiring-board connection part of the electrically-conductive contacts can be checked well until the mating retaining member is turned to a mating working position.

However, particularly along with, for example, further increase in frequencies of transmission signals in recent years, there are demands to further reduce the influence of the external electromagnetic wave noise with respect to main-body parts of the above described electrically-conductive contacts (electrically-conductive terminals) and the part connected with the wiring board and to further reliably prevent external radiation of electromagnetic wave noise from the connection part with respect to the wiring board.

The inventors of the present patent application herein disclose below conventional documents.

[Patent Document 1] Japanese Patent Application Laid-Open No. 2007-73426

[Patent Document 2] Japanese Patent Application Laid-Open No. 2011-238410

SUMMARY OF THE INVENTION

Therefore, it is an object of the present invention to provide an electric connector and an electric connector device easily and reliably enabling electromagnetic shielding about the part connected with a wiring board by a simple configuration.

In order to achieve the above described object, the invention according to a first aspect employs a configuration of an electric connector device having a first connector to which a terminal part of a signal transmission medium is coupled and a second connector mated with the first connector in a mounted state in which the second connector is connected to a wiring board; configured so that a mating retaining member provided in the first connector is configured to be subjected to a turning operation so as to cover, from an outer side, an electrically-conductive shell provided in the second connector when both of the first and second connectors are mated with each other; the mutually mated state of both of the first and second connectors is retained by the turning operation of the mating retaining member; and an electrically-conductive cover member provided at the mating retaining member covers a part of the second connector connected with the wiring board; wherein the electrically-conductive cover member is provided with a cover contact-point part that becomes a connected state with respect to the electrically-conductive shell of the second connector in the case of the turning operation of the mating retaining member.

Moreover, the invention according to a second aspect employs a configuration of an electric connector configured so that a terminal part of a signal transmission medium is coupled thereto; a mating retaining member is configured to be subjected to a turning operation so as to cover, from an outer side, an electrically-conductive shell provided in a counterpart connector when the connector is mated with the counterpart connector mounted on a wiring board in a connected state; the mating retaining member is configured to be subjected to a turning operation so as to cover, from the outer side, the electrically-conductive shell provided in the counterpart connector when mated with the counterpart connector; the mated state with the counterpart connector is retained by the turning operation of the mating retaining member; an electrically-conductive cover member provided at the mating retaining member covers a part of the counterpart connector connected with the wiring board; wherein the electrically-conductive cover member is provided with a cover contact-point part that becomes a contacted state with respect to the electrically-conductive shell of the counterpart connector in the case of the turning operation of the mating retaining member.

According to the invention according to the first aspect or the second aspect provided with such configurations, when the electrically-conductive cover member is subjected to the turning operation together with the mating retaining member after both of the connectors are mated with each other, the connection part of one of the electric connectors mounted on the wiring board and the wiring board is covered by the electrically-conductive cover member, electromagnetic shielding (shield) of the connection part with respect to the wiring board is carried out, the electrically-conductive cover member is caused to be in a grounded state through the cover contact-point part provided in the electrically-conductive cover member and the electrically-conductive shell, and a ground circuit is formed as a result. Therefore, better electromagnetic shielding characteristics (shield characteristics) are obtained.

Herein, according to the invention according to a third aspect, it is desired that the electrically-conductive cover member and the mating retaining member be composed of mutually different members; and the electrically-conductive cover member be coupled to the mating retaining member via a mechanical fixation means.

According to the invention according to the third aspect provided with such a configuration, the electrically-conductive cover member can be attached also to the mating retaining member of the electric connector, which is not provided with the electrically-conductive cover member, by so-called after attachment, and versatility of the electric connector is improved.

Moreover, according to the invention according to a fourth aspect, it is desired that the mating retaining member be formed by a rod-shaped member having a circular cross section or a rectangular cross section.

According to the invention according to the fourth aspect provided with such a configuration, even when the size/height of the electric connector is reduced, the strength of the mating retaining member is sufficiently maintained.

Moreover, according to the invention according to a fifth aspect, it is desired that the mechanical fixation means have a swage fixation piece disposed to be opposed so as to sandwich the mating retaining member.

According to the invention according to the fifth aspect provided with such a configuration, since the electrically-conductive cover member is firmly fixed by the swage fixation piece disposed to be opposed so as to sandwich the mating retaining member. Therefore, even when the size/height of the electric connector is reduced, the fixation strength of the electrically-conductive cover member can be sufficiently maintained.

Moreover, according to the invention according to a sixth aspect, it is desired that the cover contact-point part be configured to be pressure-contacted with the electrically-conductive shell of the second connector or the counterpart connector by pressing force of the mating retaining member.

According to the invention according to the sixth aspect provided with such a configuration, since the electrically-conductive cover member and the electrically-conductive shell, which carry out electromagnetic shielding, are caused to be in the pressure-contacted state, the electric connection state thereof is maintained well, and ground connectivity is improved.

Moreover, according to the invention according to a seventh aspect, it is desired that the electrically-conductive cover member be provided with a distal-end extension plate extended so as to be close to or contact the wiring board in the case of the turning operation of the mating retaining member and an elastic spring member (s) extending in a cantilever shape from the distal-end extension plate; the elastic spring member be formed so as to be bent at an intermediate position of a part extending in a cantilever shape and extended; and the cover contact-point part be formed at an extending-direction distal end part of the elastic spring member.

According to the invention according to the seventh aspect provided with such a configuration, even when the size/height of the electric connector is reduced, the span length of the elastic spring member is sufficiently ensured. Therefore, the required elasticity of the elastic spring member can be maintained well.

Moreover, according to the invention according to an eighth aspect, it is desired that a shell contact piece that contacts the contact-point part of the elastic spring member be formed on the electrically-conductive shell of the second connector or the counterpart connector; and the shell contact piece be formed so as to have a shape extending so as to rise from the wiring board and then bent back toward the wiring board.

Herein, according to the invention according to a ninth aspect, it is desired that the plurality of elastic spring members be disposed to form a row, and the shell contact piece be continuously extending along an arrangement direction of the elastic spring members.

According to the invention according to the eighth or ninth aspect provided with such a configuration, the plurality of elastic spring members are in a good contact relation with the shell contact piece. Therefore, electric connectivity of the ground circuit is improved.

As described above, the present invention is configured so that the electrically-conductive cover member provided at the mating retaining member, which retains the mutually mated state of both of the connectors, is provided with a cover contact-point part, which contacts the electrically-conductive shell of the counterpart connector when the mating retaining member is subjected to a turning operation, and the connection part of one of the electric connectors mounted on the wiring board and the wiring board is covered by the electrically-conductive cover member by subjecting the electrically-conductive cover member to the turning operation together with the mating retaining member, thereby carrying out electromagnetic shielding (shield) with respect to the part connected with the wiring board; and, by forming aground circuit by causing the electrically-conductive cover member to be in a grounded state through the cover contact-point part, which is provided at the electrically-conductive cover member, and the electrically-conductive shell, better electromagnetic shielding characteristics (shield characteristics) are obtained. Therefore, electromagnetic shielding about the part connected with the wiring board can be easily and reliably carried out by a simple configuration, and reliability of the electric connector and the electric connector device can be significantly increased at low cost.

DETAILED DESCRIPTION OF THE PREFERRED EMBODIMENT

Hereinafter, an embodiment of a case in which the present invention is applied to an electric connector and an electric connector device which connect a plurality of coaxial cables to a printed-wiring-board side will be explained in detail based on drawings.

[Outlines of Overall Structure of Electric Connector Device]

Figure 1:
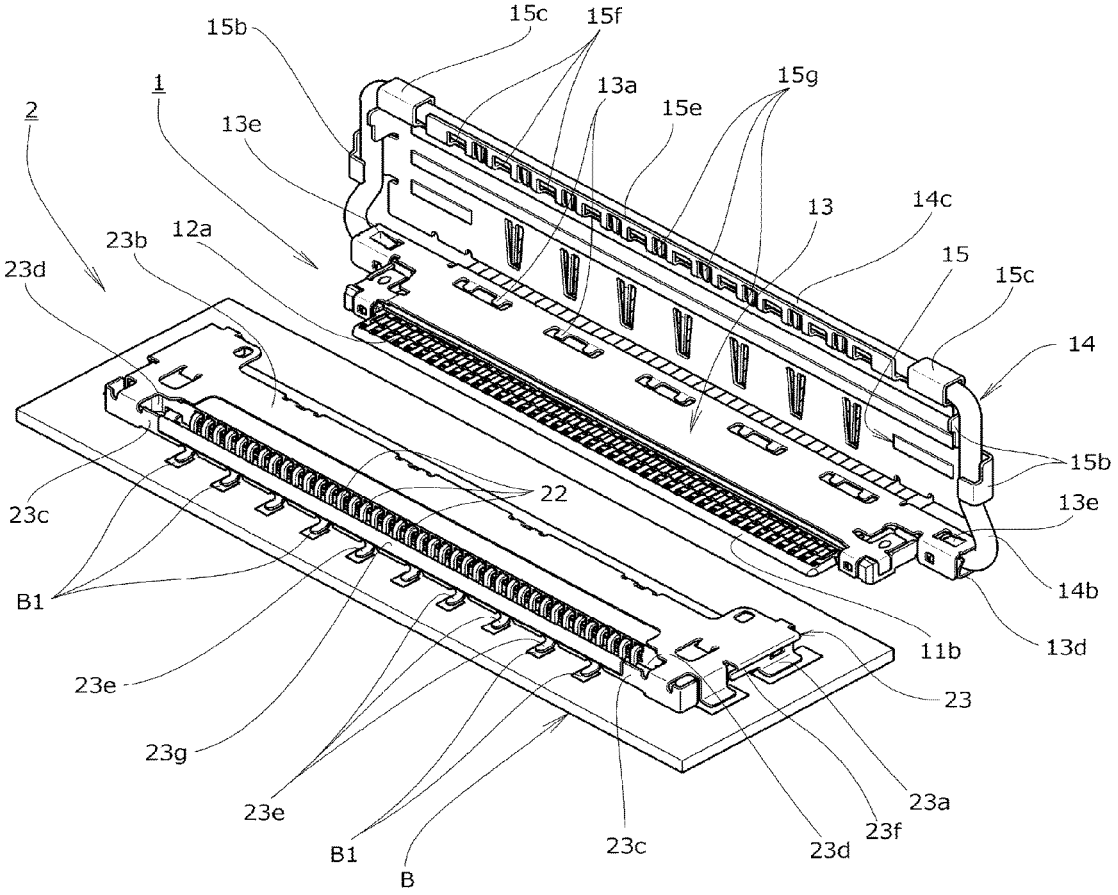
FIG. 1 is an external perspective explanatory view showing a state before mating, wherein a first connector (plug connector) and a second connector (receptacle connector), which are constituting an electric connector device according to an embodiment of the present invention, are disposed to be opposed to each other in a horizontal direction.
Figure 2:
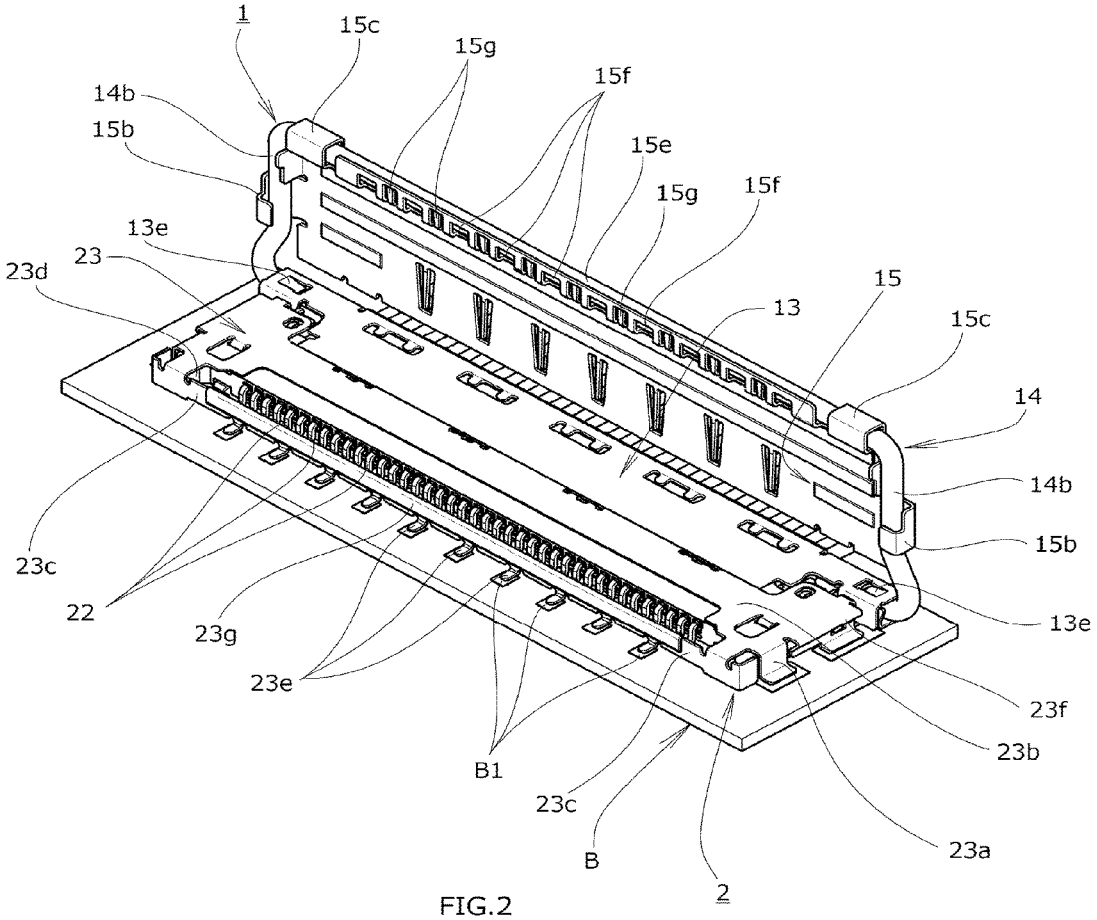
FIG. 2 is an external perspective explanatory view showing a state after mating of the first connector (plug connector) and the second connector (receptacle connector), which are constituting the electric connector device shown in FIG. 1.

First, an electric connector device according to a first embodiment of the present invention shown in FIG. 1 to FIG. 11 is an electric connector device of a horizontal mating type provided with: a plug connector 1 serving as a first connector to which terminal parts of coaxial cables SC constituting signal transmission media are coupled and a receptacle connector 2 serving as a second connector (counterpart connector) mounted on a printed wiring board B. As shown in FIG. 1, the plug connector (first connector) 1 is disposed so as to be opposed in an approximately horizontal direction with respect to the receptacle connector 2, which is mounted on a printed wiring board B and is serving as the counterpart connector of mating, and, then, the plug connector 1 is horizontally moved so as to approach the receptacle-connector-2 side in the direction approximately parallel to a surface of the printed wiring board B (extending direction of the printed wiring board B). As a result, a distal-end-side part of the plug connector 1 is inserted in the receptacle connector 2 through an opening part thereof, and both of the electric connectors 1 and 2 become a mutually mated state as shown in FIG. 2.

In this manner, in the present embodiment, the direction of inserting the plug connector (first connector) 1 into the receptacle connector (second connector) 2 serving as the counterpart connector and the direction of removing it in the opposite direction thereof are configured to be the directions approximately parallel to the direction in which the surface of the printed wiring board B is extending. Hereinafter, the extending direction of the surface of the printed wiring board B will be referred to as "horizontal direction", and the direction perpendicular to the surface of the printed wiring board B will be referred to as "top-bottom direction". Also, in the plug connector 1, the direction of inserting the plug connector 1 into the receptacle connector 2 will be referred to as "forward direction", and the direction of removing it in the opposite direction thereof will be referred to as "backward direction". Furthermore, in the receptacle connector 2, the direction of removing the plug connector 1 from the receptacle connector 2 will be referred to as "forward direction", and the opposite direction thereof will be referred to as "backward direction".

Both of the electric connectors, i.e., the plug connector (first connector) 1 and the receptacle connector (second connector) 2 constituting the electric connector device like this are respectively provided with insulating housings 11 and 21 (shown in FIG. 7) as connector main-body parts composed of insulating members, which are formed in long-and-thin shapes. A plurality of electrically-conductive contact members (electrically-conductive terminals) 12 or 22 serving as contact members are arranged on the insulating housing (connector main-body part) 11 or 21 along the longitudinal direction (the direction perpendicular to the paper plane of FIG. 7) of the insulating housing 11 or 21 so as to form multipolar shapes at appropriate pitch intervals.

Moreover, terminal parts of the plurality of coaxial cables SC, which are arranged in multipolar shapes along the connector longitudinal direction, are coupled to a rear-side edge part (hereinafter, referred to as "rear edge part") of the plug connector (first connector) 1 among both of the above described electric connectors 1 and 2. At the terminal part of each of the coaxial cables SC, particularly as shown in FIG. 7 to FIG. 10, a cable central conductor (signal wire) SCa and a cable external conductor (shield wire) SCb are exposed so as to form a coaxial shape since a covering material is peeled off. Then, when the cable central conductor SCa, which is disposed so as to extend along a central axis of the coaxial cable SC, is connected to the electrically-conductive contact member (electrically-conductive terminal) 12 or 22 for signal transmission, a signal circuit is formed. The connection structure about the cable central conductor SCa will be explained later in detail.

Moreover, the cable external conductor SCb, which is disposed so as to concentrically surround the outer peripheral side of the above described cable central conductor SCa, is disposed so as to penetrate through the interior of a ground bar GB, which is constituting an electrically-conductive ground member. The ground bar GB in the present embodiment is formed by a long-and-thin block-shaped member extending in a long shape along the direction of the multipole arrangement of the above described coaxial cables SC (connector longitudinal direction), and the ground bar GB is connected collectively to the cable external conductors (shield wires) SCb of the coaxial cables SC by soldering, swaging, pressure contacting, or the like. The ground bar GB provided in this manner is connected to a ground circuit, which is formed on the printed wiring board B, via a later-described electrically-conductive shell, etc.

[Insulating Housings and Electrically-Conductive Contact Members]

Herein, both of the electric connectors, i.e., the above described plug connector (first connector) 1 and the receptacle connector (second connector) 2 are respectively provided with the long-and-thin-shaped insulating housings (connector main-body parts) 11 and 21, which are extending in long-and-thin shapes along the multipole arrangement direction (connector longitudinal direction) of the electrically-conductive contact members (electrically-conductive terminals) 12 or 22 as described above; wherein, the electrically-conductive contact members 12 or 22, which are attached to the insulating housing 11 or 21, are arranged so that those having the same shapes have constant intervals along the multipole arrangement direction (connector longitudinal direction).

On the other hand, the insulating housing 11, which is provided in the plug-connector-1 side is formed by an insulating member of resin or the like extending in the connector longitudinal direction (multipole arrangement direction) as described above, and the insulating housing 11 is configured to be integrally provided with a main-body supporting part 11*a* as a connector main-body part disposed in the interior side of the plug connector and a mating projecting part 11*b* provided so as to extend from the main-body supporting part 11*a* toward a connector front side. A ground contact GC, which contacts the above described ground bar GB, is buried in a lower-surface-side part of the main-body supporting part 11*a* to the mating projecting part 11*b* of the insulating housing 11 by insert molding or press fitting. The ground contact GC is disposed in a state in which it is exposed to a lower-surface-side surface from the main-body supporting part 11*a* to the mating projecting part 11*b* and is in a disposition relation in which the ground contact GC contacts an inner surface side of a later-described second shield shell member 23 of the second connector (counterpart connector) in a case of mutual mating of both of the electric connectors 1 and 2.

Furthermore, the electrically-conductive contact members (first contact members) 12 are buried in an upper-surface-side part of the main-body supporting part 11*a* to the mating projecting part 11*b* of the above described insulating housing 11 by insert molding or press fitting. The electrically-conductive contact members 12 are disposed in a state in which they extend approximately horizontally so as to be exposed to the upper side from the upper surface of the insulating housing 11.

The terminal parts of the cable central conductors (signal wires) SCa of the coaxial cables SC are solder-connected to rear end parts of the electrically-conductive contact members (first contact members) 12, which are provided in the plug connector (first connector) 1 like this, in a state in which the terminal parts are abutting them from the upper side. The solder joint between the cable central conductor SCa and the electrically-conductive contact member 12 herein can be collectively carried out with respect to a plurality of places in the multipole arrangement direction, and such collective solder joint efficiently couples the plurality of coaxial cables SC to the electrically-conductive contact members 12 of the plug connector 1.

On the other hand, terminal electrode parts 12*a*, which constitute front-side parts of the above described electrically-conductive contact members (first contact members) 12, are disposed on an upper surface of the mating projecting part 11*b*, which is provided in a front end side of the insulating housing (connector main-body part) 11 as described above, so as to form multipolar exposed electrodes. When the plug connector (first connector) 1 is mated with the receptacle connector (second connector) 2 in the above described manner, the terminal electrode parts 12*a*, which constitute front-side extension parts of the electrically-conductive contact members 12, abut the electrically-conductive contact members (second contact members) 22, which are provided in the receptacle connector 2, from the lower side, thereby forming signal transmission circuits. Note that some of the plurality of electrically-conductive contact members 12 and 22 can be formed for ground connection.

Moreover, front-side parts of the above described ground contact GC is disposed on a lower surface of the mating projecting part 11*b*, which is provided in the front end side of the insulating housing (connector main-body part) 11, so as to form multipolar exposed electrodes. When the plug connector (first connector) 1 is mated with the receptacle connector (second connector) 2 in the above described manner, the front-side extension parts of the ground contact GC abut an inner surface of a bottom plate of the second shield shell member 23, which is attached to the receptacle connector (second connector) 2, from the upper side, thereby forming a ground circuit.

Furthermore, the electrically-conductive contact members (second contact members) 22, which are attached to the insulating housing (connector main-body part) 21 in the receptacle-connector (second connector) 2 side, are arranged so as to form multipolar shapes in the connector longitudinal direction at the positions corresponding to the electrically-conductive contact members (first contact members) 12 in the above described plug-connector (first connector) 1 side. The electrically-conductive contact members (second contact members) 22, which are attached to the receptacle connector (second connector) 2, are configured to elastically contact the electrically-conductive contact members 12 of the plug-connector-1 side from the upper side in a case of mutual mating of both of the electric connectors 1 and 2.

Meanwhile, the rear end part (right-end-side part in FIG. 7 to FIG. 10) of each of the electrically-conductive contact members (second contact members) 22 of the receptacle connector (second connector) 2 has a board connecting leg part 22*a*, which is formed so as to extend along the surface of the above described printed wiring board B. In a case of actual usage (in a case of actual mounting), the board connecting leg parts 22*a* are placed on signal electrically-conductive paths or ground-connection electrically-conductive paths on the above described printed wiring board B and are then subjected to, for example, collective solder joint.

A main-body part of the electrically-conductive contact member (second contact member) 22 in the present embodiment has undergone bending so as to rise toward the upper side from the above described board connecting leg part 22*a*, which is disposed in the connector rear end side, and is configured to extend in a cantilever shape from an upper end part of the rising part toward the front side (left side in FIG. 7 to FIG. 10). Connector-front-side distal end parts of the electrically-conductive contact members 22 are respectively provided with contact-point convex parts 22*b*, which are bulging in mountain shapes toward the lower side. A lower apex part of the contact-point convex part 22*b*, which is provided on the electrically-conductive contact member 22, is configured to elastically contact the terminal electrode part 12*a* of the electrically-conductive contact member (first contact member) 12 of the plug-connector-1 side from the upper side when the plug connector (first connector) 1 is mated with the receptacle connector (second connector) 2 in the above described manner. By such an elastic contact relation, the electric connection mutually between both of the contact-point parts 12*a* and 22*b* is established.

[About Electrically-Conductive Shells (Shield Shell Members)]

On the other hand, as shown by FIG. 2, outer surfaces of the insulating housings (connector main-body parts) 11 and 21, which are provided in the plug connector (first connector) 1 and the receptacle connector (second connector) 2, are respectively covered by electrically-conductive first and second shield shell members (electrically-conductive shells) 13 and 23, which are formed by bending thin-plate-shaped metal members into appropriate shapes. The first and second shield shell members 13 and 23 are attached as the members providing electromagnetic shielding properties (shield properties) by covering the signal transmission circuits and ground circuit formed in the electric connectors 1 and 2 and are also the members which constitute part of the ground circuit.

Herein, the first shield shell member 13, which is provided in the plug-connector (first connector) 1 side, is composed of mating bodies of a pair of shell pieces sandwiching the insulating housing (connector main-body part) 11 from above/below. Both of the shell piece members are formed by bent structures of thin-plate-shaped metal members; wherein, first, the terminal parts of the coaxial cables SC are set so as to be placed on the insulating housing (connector main-body part) 11, the ground bar (ground member) GB is solder-joined with the external conductors SCb of the coaxial cables SC, and, then, both of the shell piece members, i.e., an upper half part and a lower half part of the above described shield shell member 13 are attached to the insulating housing (connector main-body part) 11 so as to cover it from the upper side and the lower side.

On the upper-half shell piece member of the first shield shell member 13 like this, a plurality of ground-connection tongue pieces 13*a* are formed along the connector longitudinal direction, which is the multipole arrangement direction, by cut-away processing. The ground-connection tongue pieces 13*a* are cut and raised so as to form cantilever plate spring shapes projecting in an oblique direction toward the space in the connector inner side and elastically contact or are solder-joined with the upper surface side of the above described ground bar GB.

[Electrically-Conductive Shell (Shield Shell Member) of Receptacle Connector]

On the other hand, the second shield shell member 23 of the receptacle connector (second connector) 2, which is the counterpart connector, is also composed of mating bodies of a pair of shell pieces sandwiching the insulating housing (connector main-body part) 21 from above/below. Both of the shell piece members are formed by bent structures of thin-plate-shaped metal members, and holddowns 23*a* are disposed at connector-longitudinal-direction both end parts of the upper-half shell piece member so as to sandwich the insulating housing 21 from both outer sides in the same direction as shown in FIG. 1 and so as to rise from the surface of the printed wiring board B.

A pair of the holddowns 23*a* is provided on each connector-longitudinal-direction one-side part so as to form lateral wall plates of the second shield shell member 23, and lower edge parts of the holddowns 23*a* are solder-joined with ground-connection electrically-conductive paths formed on the printed wiring board B so that the electrical connection of the ground circuit is established by that and so that the entirety of the receptacle connector 2 is firmly fixed.

Moreover, both of the holddowns 23*a* and 23*a*, which are disposed so as to form the lateral wall plates at the connector-longitudinal-direction both end parts as described above, are integrally coupled by an upper shell plate 23*b*, which is extending so as to form a planar ceiling plate along the upper surface of the insulating housing 21. A front edge part of the upper shell plate 23*b*, which is extending in the connector longitudinal direction, forms a laterally-long mating opening part between the front edge part and a front edge part of the lower-half shell piece member, which is similarly extending in the connector longitudinal direction, so that the mating projecting part 11*b* of the above described plug connector (first connector) 1 is inserted in the receptacle connector (second connector) 2 through the mating opening part.

Furthermore, a fixation shield plate 23*c*, which is extending in the connector longitudinal direction, is provided at a connector-rear-end-side part of the second shield shell member 23, which is provided in the receptacle connector (second connector) 2, so as to form a back surface plate, which rises from the surface of the printed wiring board B. The fixation shield plate 23*c* is formed by a band-plate-shaped member extending in the connector longitudinal direction, which is the above described multipole arrangement direction; wherein, an upper edge part of the fixation shield plate 23*c* rising from the surface of the printed wiring board B is bent back to the lower side toward the printed wiring board B and formed into a shell contact piece 23*g*. The shell contact piece 23*g*, which is bent and formed so as to form a downward bent-back part of the upper edge part of the fixation shield plate 23*c*, is in a disposition relation in which it contacts a later-described cover contact-point part provided on an electrically-conductive cover member 15.

Herein, in the upper shell plate 23*b*, which is disposed so as to form the ceiling plate of the above described second shield shell member 23, a shell opening part 23*d* is formed at a part positioned above the rear end parts of the electrically-conductive contact members (second contact members) 22. The shell opening part 23*d* is formed so as to cut away a rear-side region of the upper shell plate 23*b* and, more specifically, is formed so as to extend in a long and thin shape along the connector longitudinal direction in the region positioned above the board connecting leg parts 22*a*, which are the rear end parts of the electrically-conductive contact members 22, and vicinity parts thereof (upward rising parts). Since the shell opening part 23*d* has an opening length across the full width of the multipole arrangement of the electrically-conductive contact members 22, the rear end parts of the electrically-conductive contact members (second contact members) 22 including the board connecting leg parts 22*a* and the insulating housing 21 can be visually checked through the shell opening part 23*d* from the upper side perpendicular to the surface of the printed wiring board B.

On the other hand, the shell opening part 23*d* is formed so as to cut away the rear-side region of the upper shell plate 23*b* as described above; wherein the connector-rear-end-side edge part of the shell opening part 23*d* is formed by the fixation shield plate 23*c*, which is disposed to form the back surface plate. More specifically, the fixation shield plate 23*c* is formed by the thin-plate-shaped metal member disposed so as to rise from the surface of the printed wiring board B in the rear-side region of the board connecting leg part 22*a* of the electrically-conductive contact members (second contact members) 22, and the shell contact piece 23*g*, which is extending in the connector longitudinal direction so as to form the upper edge part of the fixation shield plate 23*c*, forms the rear edge part of the above described shell opening part 23*d*.

Herein, the fixation shield plate 23*c*, which forms the back surface plate of the second shield shell member 23, is disposed in the region close to the board connecting leg parts 22*a* of the electrically-conductive contact members (second contact members) 22 from the connector rear side. The fixation shield plate 23*c* is disposed so as to rise upward from the surface of the printed wiring board B as described above; wherein, the fixation shield plate 23*c* is in a disposition relation that it faces the board connecting leg parts 22*a* of the electrically-conductive contact members 22 in the horizontal direction from the connector rear side so as to carry out electromagnetic shielding (shield) in the horizontal direction parallel to the surface of the printed wiring board B.

Moreover, at lower edge parts of the fixation shield plate 23*c*, a plurality of (ten) ground connection parts 23*e*, 23*e*, and so on, which contact ground electrically-conductive paths B1 formed on the surface of the printed wiring board B, are formed so as to be bent and project at approximately right angle toward the connector rear side. The ground connection parts 23*e* are formed so as to cut and raise the lower edge parts of the fixation shield plate 23*c* and are disposed at approximately equal intervals in the connector longitudinal direction.

On the other hand, corresponding to the ground connection parts 23*e*, the plurality of (ten) ground electrically-conductive paths B1, B1, and so on are formed on the surface of the printed wiring board B so as to be juxtaposed at approximately equal intervals in the connector longitudinal direction. The ground electrically-conductive paths B1 are formed in the regions close to the connector rear side with respect to the board connecting leg parts 22*a* of the electrically-conductive contact members (second contact members) 22, which are provided in the above described receptacle connector (second connector) 2, and are disposed at the positions corresponding to the ground connection parts 23*e* of the above described fixation shield plate 23*c*. The ground connection parts 23*e*, which are provided at the fixation shield plate 23*c* in this manner, are for example collectively solder-connected in a state in which they are placed on the ground electrically-conductive paths B1, which are provided in the printed-wiring-board-B side.

In the state in which the fixation shield plate 23*c* is connected to the ground electrically-conductive paths B1 via the ground connection parts 23*e* in the above described manner, ground circuits are formed in the vicinity of the position at which electromagnetic shielding (shield) is carried out by the fixation shield plate 23*c*. The electrically-conductive cover member 15, which is provided at a later-described mating retaining member (mating operating lever) 14 in the plug-connector (first connector) 1 side, is configured to contact the fixation shield plate 23*c* like this.

[Mating Retaining Member]

More specifically, the mutually mated state of both of the electric connectors 1 and 2 of the case in which the plug connector (first connector) 1 is mated with the receptacle connector (second connector) 2 as the mating counterpart connector in the above described manner is configured to be maintained by the retention force of the mating retaining member (mating operating lever) 14, which is provided in the plug connector 1. Note that, when the plug connector 1 mated with the receptacle connector 2 is to be removed from the receptacle connector 2, a state in which both of the electric connectors 1 and 2 can be removed from each other is obtained by carrying out an operation of opening the mating retaining member 14.

Figure 6:
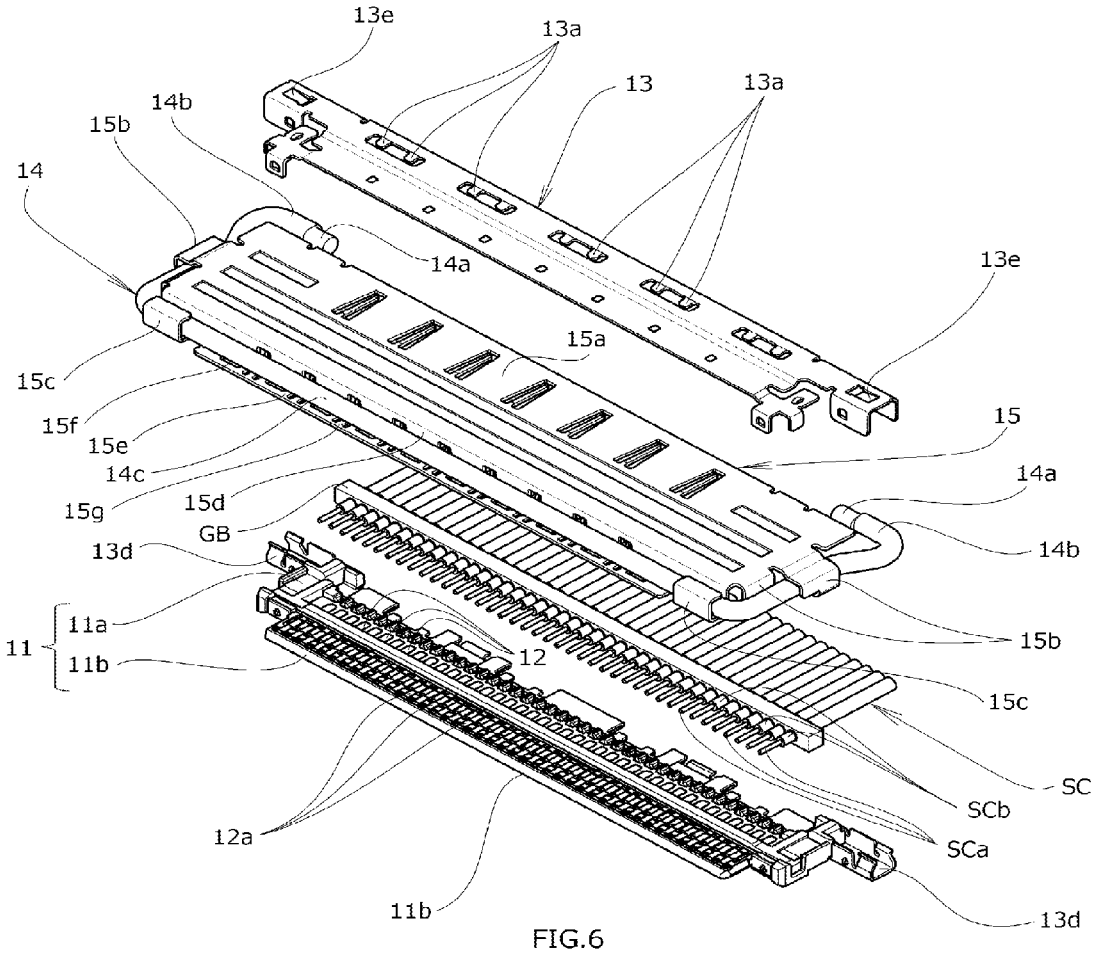
FIG. 6 is an explanatory exploded perspective view showing the structure of the first connector (plug connector) shown in FIG. 1 to FIG. 5.
Figure 7:
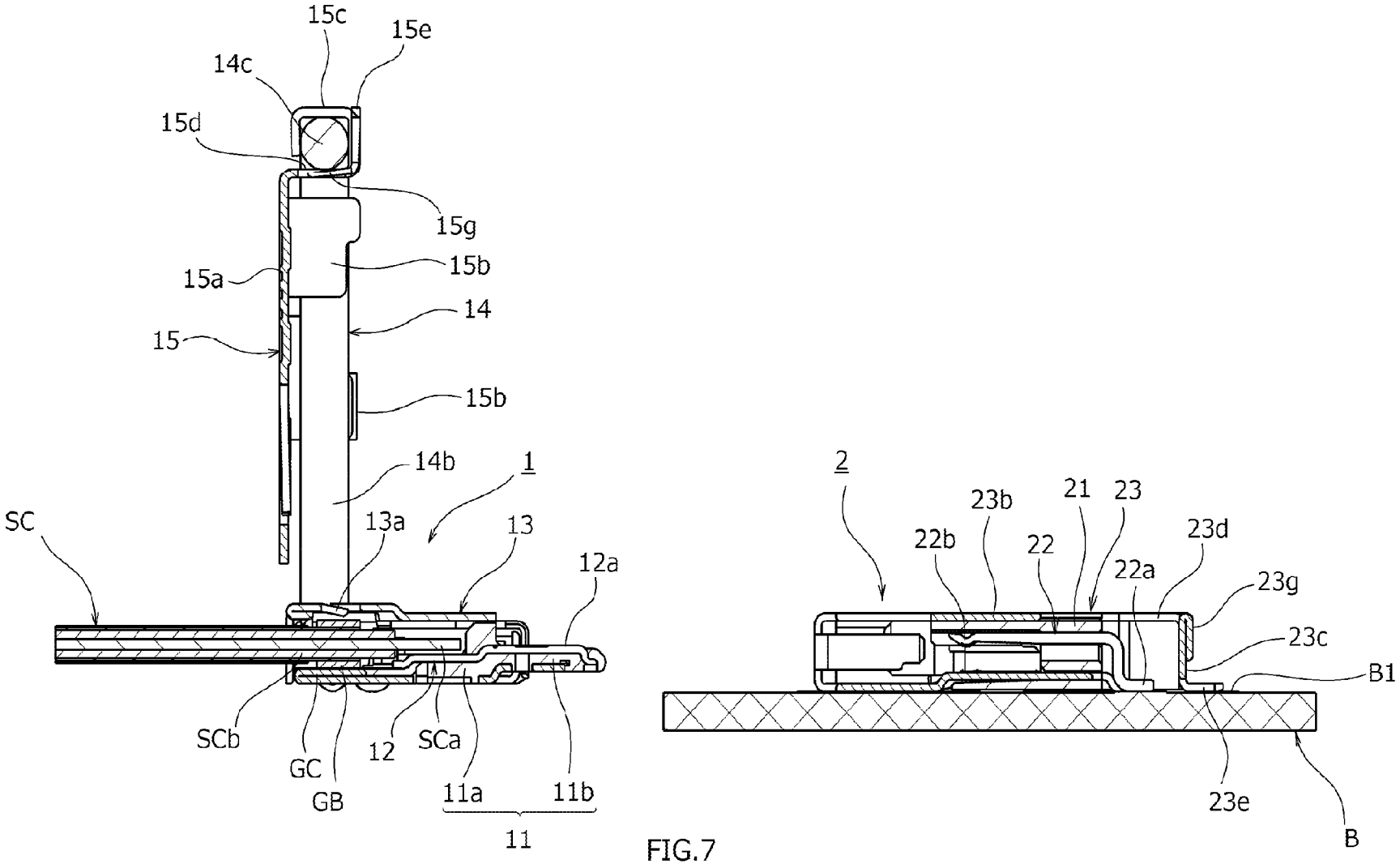
FIG. 7 is an explanatory transverse cross-sectional view of a position passing through an axis of a coaxial cable in the electric connector device before mating shown in FIG. 1.
Figure 8:
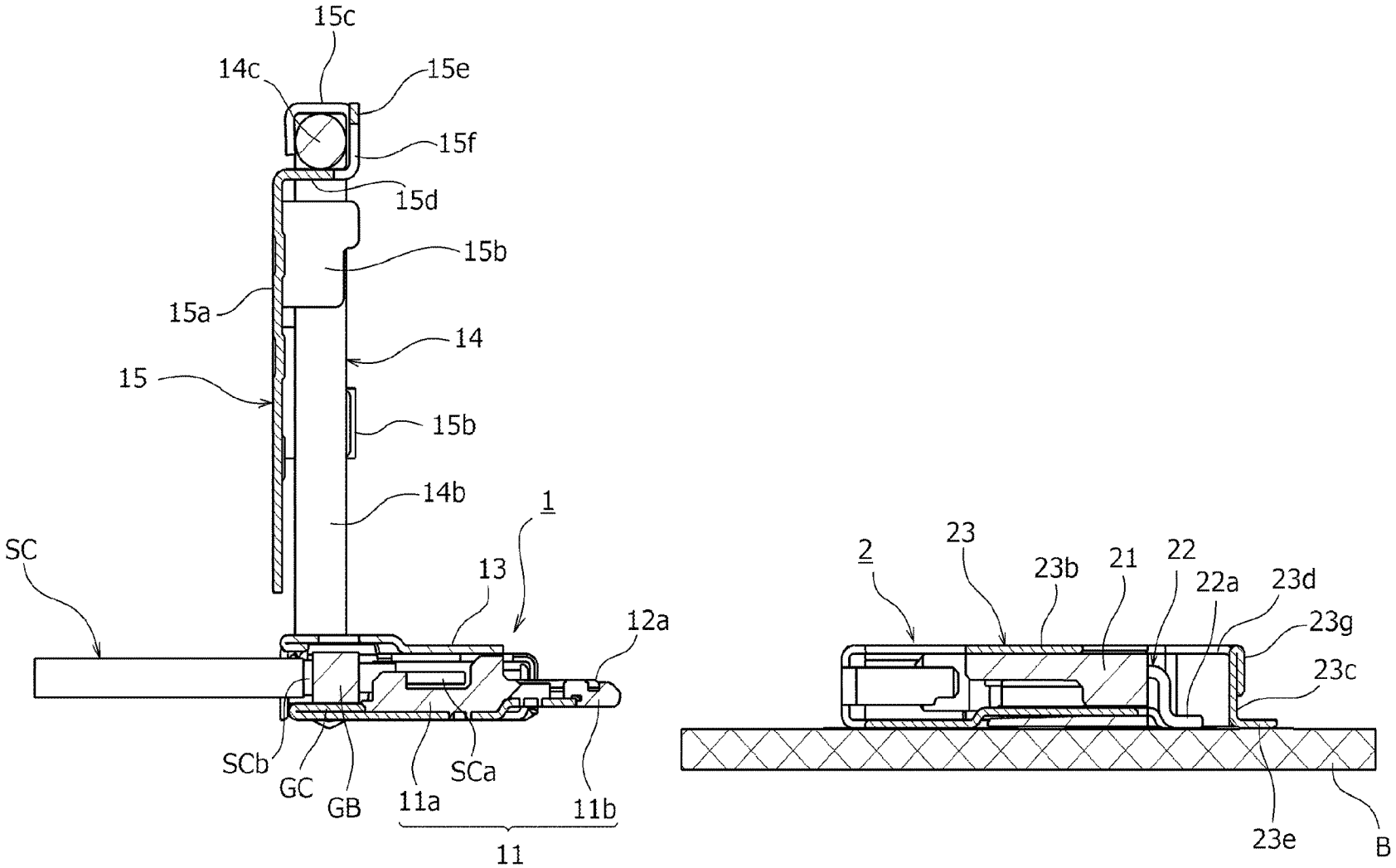
FIG. 8 is an explanatory transverse cross-sectional view of a position between coaxial cables in the electric connector device before mating shown in FIG. 1.
Figure 9:
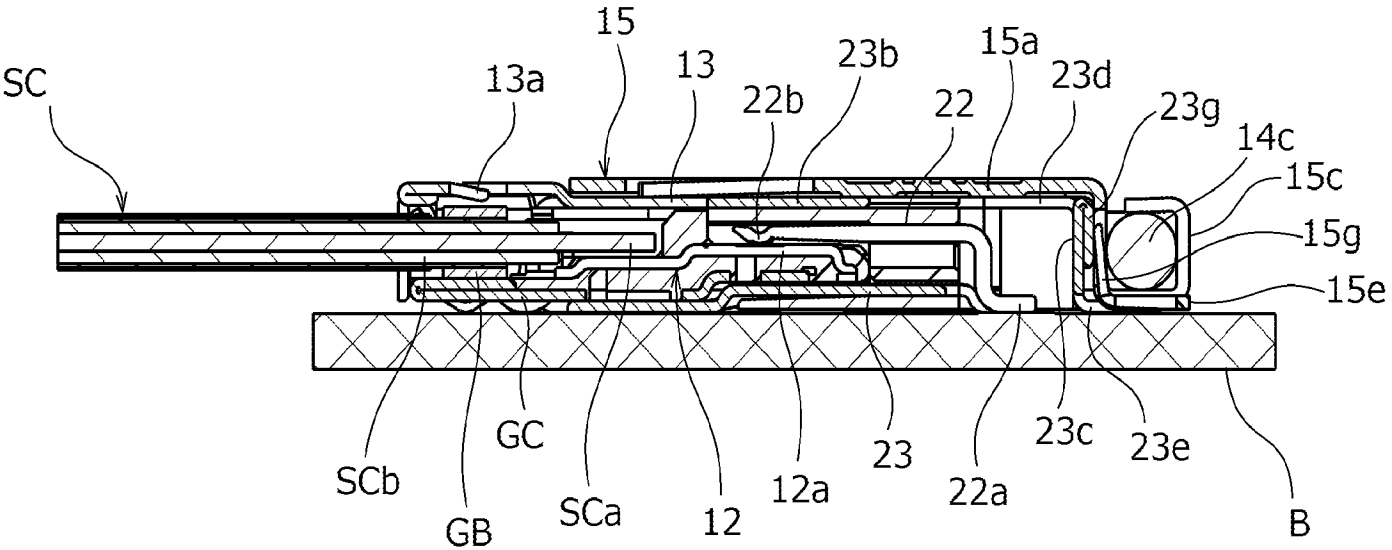
FIG. 9 is an explanatory transverse cross-sectional view of a position passing through the axis of the coaxial cable in the electric connector device after mating shown in FIG. 3.

In more detail, as shown in FIG. 6, the mating retaining member (mating operating lever) 14 is turnably attached to the first shield shell member 13 of the above described plug connector (first connector) 1, and turning shaft parts 14*a* and 14*a*, which are provided at connector-longitudinal-direction both-end parts of the mating retaining member 14, are turnably inserted in a loosely mated state in bearing parts 13*d* and 13*d*, which are provided at connector-longitudinal-direction both-end parts of the rear end part of the first shield shell member 13.

The pair of turning shaft parts 14*a* and 14*a*, which are provided in the mating retaining member (mating operating lever) 14, are formed so as to form approximately circular shapes as transverse cross-sectional shapes and extend in the connector longitudinal direction and have radial-direction uneven parts (axis-shifted parts) at intermediate parts in the extending direction. The biasing force of spring regulating members 13*e*, which are provided at the bearing parts 13*d*, is configured to be applied to the uneven parts of the turning shaft parts 14*a*, and the turning shaft parts 14*a* are configured to be retained at "unshielded position (mating released position)" and "shielded position (mating working position)" described later by the biasing force applied from the spring regulating members 13*e* to the uneven parts (axis-shifted parts) of the turning shaft parts 14*a*.

Moreover, from connector-longitudinal-direction both-side outer end parts of the turning shaft parts 14*a* of the mating retaining member (mating operating lever) 14, a pair of coupling arm parts 14*b* and 14*b* are extending so as to be bent toward the turning-radius outer side. The coupling arm parts 14*b* and 14*b* are obliquely extending so as to approach each other toward the connector central side from the parts immediately after they extend so as to bend from the above described turning shaft parts 14*a* and 14*a*, and the coupling arm parts 14*b* and 14*b* are then extending so as to be along the turning radius of the mating retaining member 14. Furthermore, at the turning-radius outer end parts of the coupling arm parts 14*b* and 14*b*, a turning operating part 14*c*, which integrally couples turning-side distal end parts of the coupling arm parts 14*b* and 14*b* to each other, is extending in an elongated shape along the connector longitudinal direction.

Figure 3:
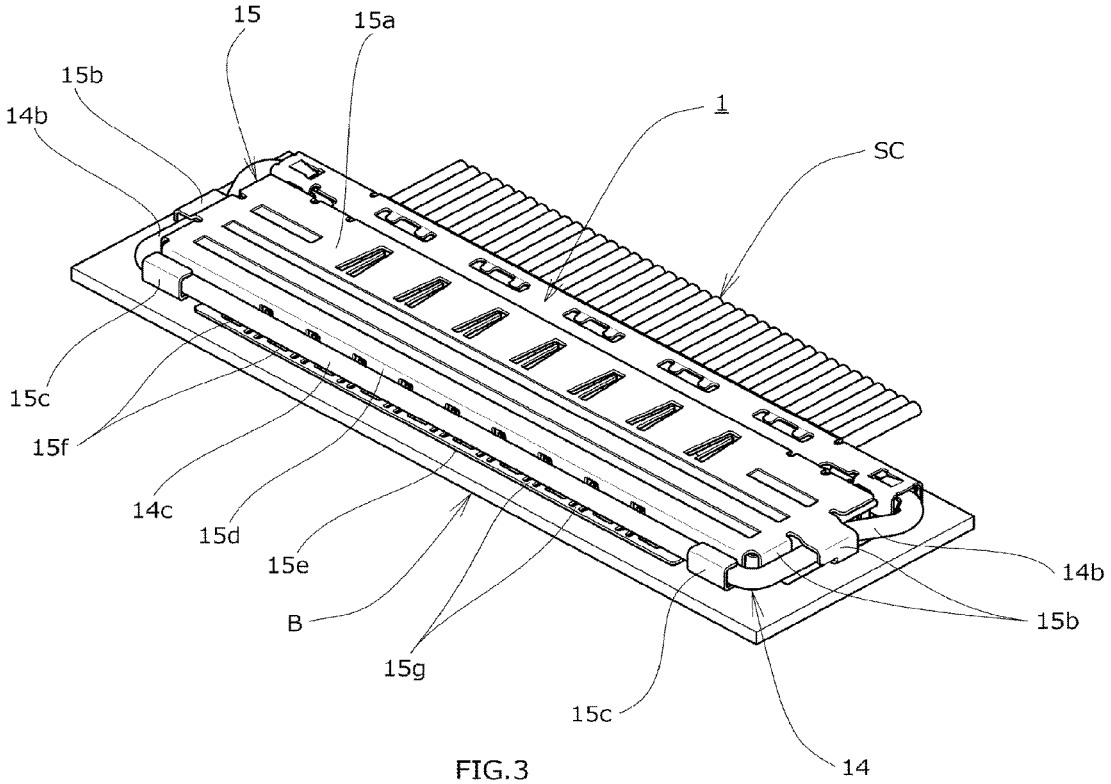
FIG. 3 is an external perspective explanatory view showing the electric connector device in a state in which a mating retaining member raised to a "mating released position" in the state after the mating of FIG. 2 is subjected to a turning operation to a "mating working position" where it becomes approximately horizontal.
Figure 4:
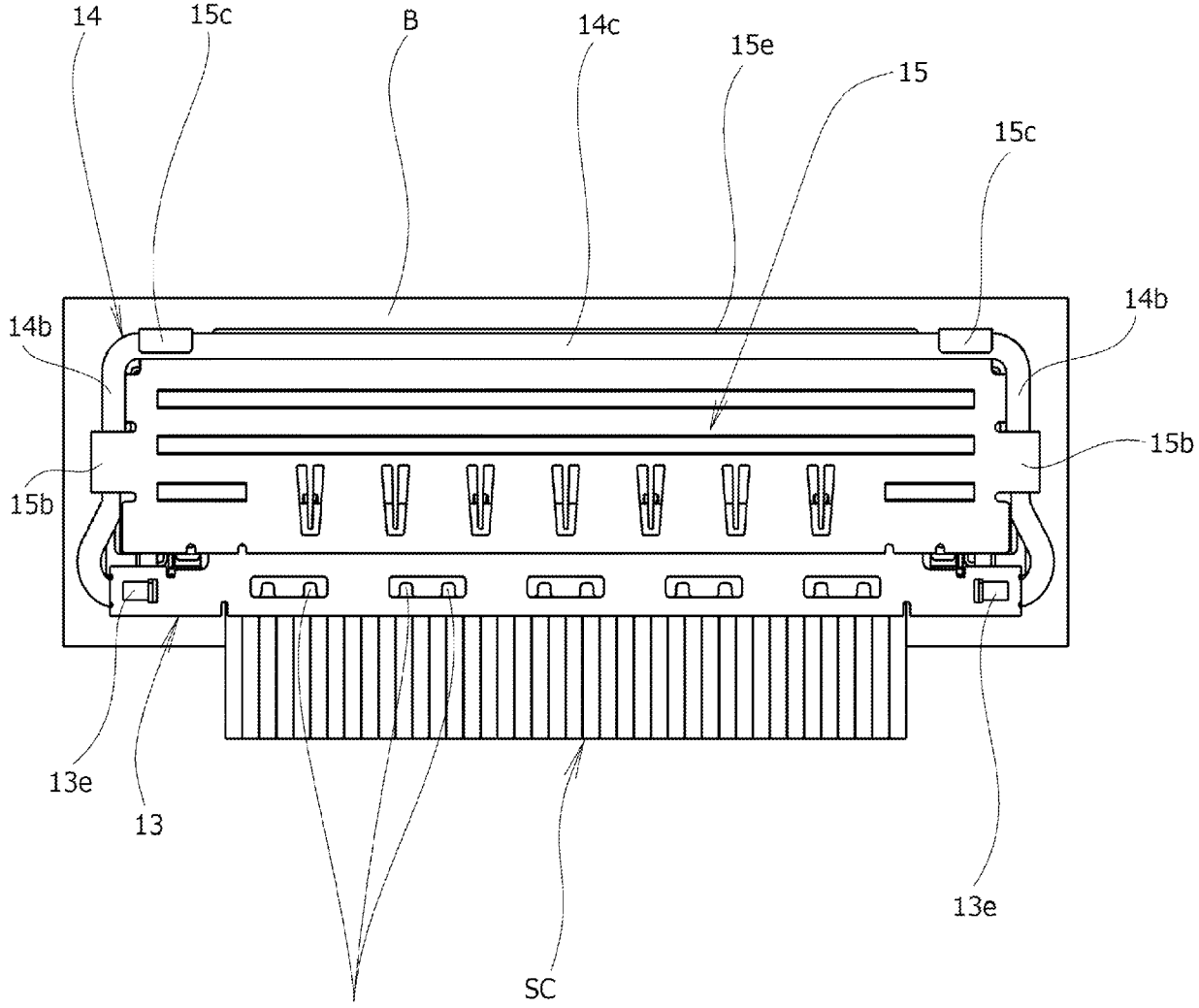
FIG. 4 is an explanatory plan view showing the electric connector device in a mutually mated state of both of the connectors shown in FIG. 3.
Figure 5:
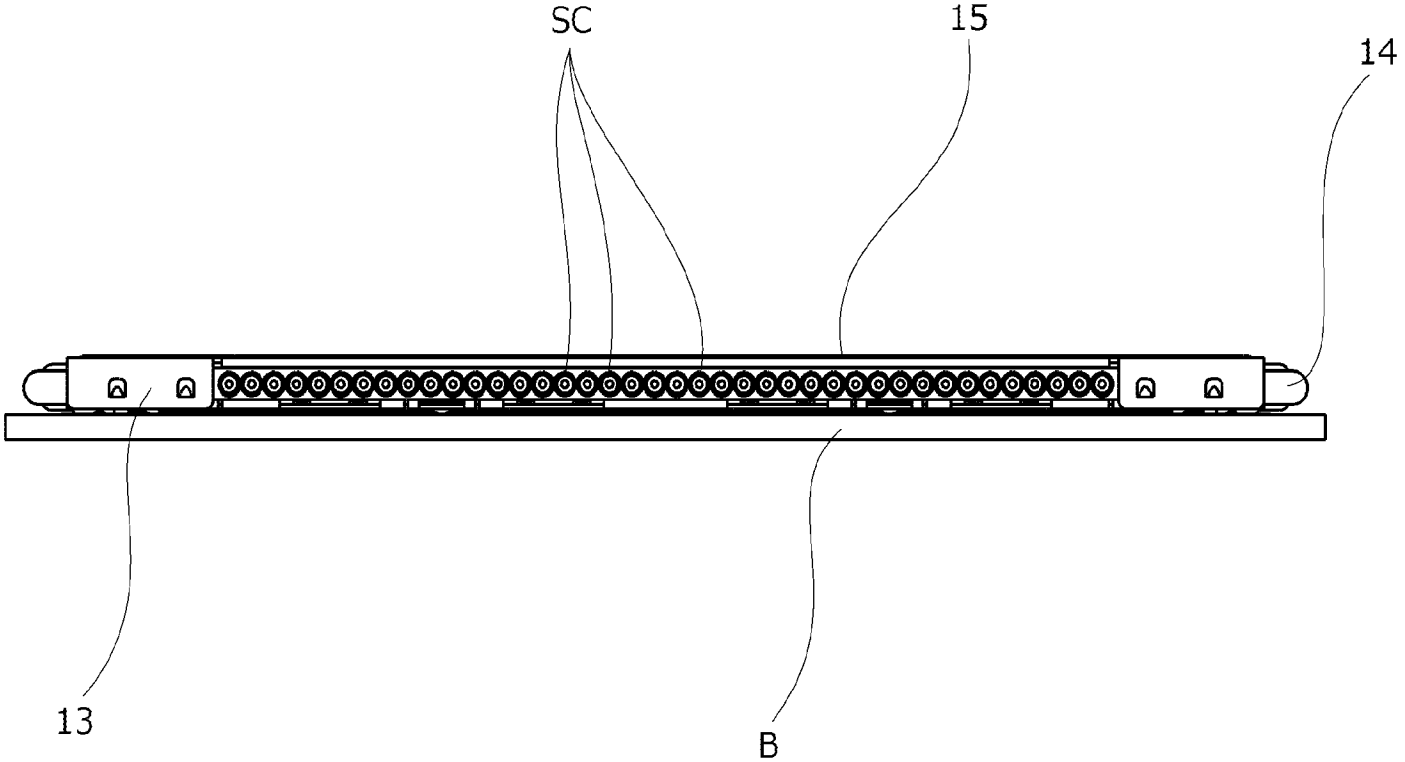
FIG. 5 is an explanatory front view showing the electric connector device in the mutually mated state of both of the connectors shown in FIG. 3 and FIG. 4.

When an assembly worker holds and, at the same time applies appropriate turning force to part of the turning operating part 14*c*, the entirety of the mating retaining member (mating operating lever) 14 is configured to be turned between the "unshielded position (mating released position)" shown in FIG. 2 and the "shielded position (mating working position)" shown in FIG. 3 to FIG. 5. After mutual mating of both of the connectors 1 and 2 is completed, when the retaining member 14 is subjected to a turning operation to the "shielded position (mating working position)", the mutually mated state of both of the connectors 1 and 2 is maintained.

Furthermore, the holddowns 23*a*, which are provided in the second shield shell member 23 of the receptacle connector (second connector) 2 in the above described manner, are provided with lock parts 23*f*, which are to be mated with the coupling arm parts 14*b* of the mating retaining member (mating operating lever) 14 turned to the above described "shielded position (mating working position)" as shown in FIGS. 1 and 2. Each of the lock parts 23*f* is formed by an elastic spring member bulging outward in the connector longitudinal direction. When the mating retaining member 14 is turned to the vicinity of the "shielded position (mating working position)" after both of the electric connectors 1 and 2 are mutually mated, the coupling arm parts 14*b*, which are provided in the mating retaining member 14, move over the outward bulging parts of the lock parts 23*f* of the above described receptacle-connector-2 side, are then moved so as to be elastically displaced toward the connector inner side, and are dropped to the lower side of the lock parts 23*f*, thereby causing both of them to be in an engaged state; and, as a result, the entirety of the mating retaining member 14 is elastically retained at the "shielded position (mating working position)".

When the mating retaining member (mating operating lever) 14 is turned from the "unshielded position (mating released position) to the "shielded position (mating working position)" in the state in which the plug connector (first connector) 1 is mated with the receptacle connector (second connector) 2 in this manner, both of the electric connectors 1 and 2 are maintained in the mutually mated state without being separated by external force, which is in a certain range.

Moreover, the electrically-conductive cover member 15, which is composed of an electrically-conductive thin-plate-shaped member different from the mating retaining member 14, is attached to the above described mating retaining member (mating operating lever) 14. The electrically-conductive cover member 15 is composed of a lid-like body, which is bent and formed so as to cover the second shield shell member 23 of the above described receptacle connector (second connector) 2, and is provided with an upper-surface-side shield cover 15*a*, which is disposed so as to be overlapped with the second shield shell member 23 from the upper side, as a main component part. The upper-surface-side shield cover 15*a* is integrally provided with lateral-part fixation plates 15*b* and front-part fixation plates 15*c*, which are additionally provided so as to form mechanical fixation means at outer peripheral parts of the upper-surface-side shield cover 15*a*, and is attached to the above described mating retaining member 14 by interposing the lateral-part fixation plates 15*b* and the front-part fixation plates 15*c*.

The upper-surface-side shield cover 15*a* constituting a main part of the electrically-conductive cover member 15 forms a ceiling plate when the above described mating retaining member (mating operating lever) 14 is turned to the "mating working position", and the upper-surface-side shield cover 15*a* is configured to cover the upper shell plate 23*b* provided in the second shield shell member 23 in the receptacle-connector (second connector) 2 side, the shell opening part 23*d*, and the upper-side parts of the rear end parts of the electrically-conductive contact members (second contact members) 22. Since the upper-surface-side shield cover 15*a* of the electrically-conductive cover member 15 is in a disposition relation in which it faces the rear end parts including the board connecting leg parts 22*a* of the electrically-conductive contact members 22 so as to be overlapped therewith from the upper side in this manner, electromagnetic shielding (shield) in the top-bottom direction perpendicular to the surface of the printed wiring board B is carried out.

Moreover, the lateral-part fixation plates 15*b* of the electrically-conductive cover member 15 are provided so as to project from connector-longitudinal-direction both-side edge parts of the above described upper-surface-side shield cover 15*a* toward the connector-longitudinal-direction outer side and are bent at approximately right angle so as to be wound around the outer peripheral side of round-rod-shaped members constituting the coupling arm parts 14*b* of the mating retaining member (mating operating lever) 14, and, as a result, the lateral-part fixation plates 15*b* are swage-fixed to the coupling arm parts 14*b* of the mating retaining member 14.

Furthermore, the front-part fixation plates 15*c* of the electrically-conductive cover member 15 are continuously provided so as to project from the connector-longitudinal-direction both-side parts of the turning-radius outer edge of the above described upper-surface-side shield cover 15*a* toward the turning-radius outer side, the front-part fixation plates 15*c* are bent approximately at right angle so as to be wound around the outer peripheral side of the round-rod-shaped member constituting the turning operating part 14*c* of the above described mating retaining member (mating operating lever) 14, and, as a result, the front-part fixation plates 15*c* are swage-fixed to the turning operating part 14*c* of the mating retaining member 14.

In this manner, the lateral-part fixation plates 15*b* and the front-part fixation plates 15*c*, which are provided at the outer peripheral parts of the upper-surface-side shield cover 15*a* of the electrically-conductive cover member 15 so as to form the mechanical fixation means, are formed by swage fixation pieces which are disposed to be opposed so as to sandwich the mating retaining member (mating operating lever) 14 in the radial direction. In other words, since the electrically-conductive cover member 15, which is formed so as to form the part different from the mating retaining member 14, is attached to the mating retaining member 14 by interposing the lateral-part fixation plates 15*b* and the front-part fixation plates 15*c* as the mechanical fixation means, the electrically-conductive cover member 15 is configured to be easily and firmly fixed by so-called after attachment.

Figure 10:
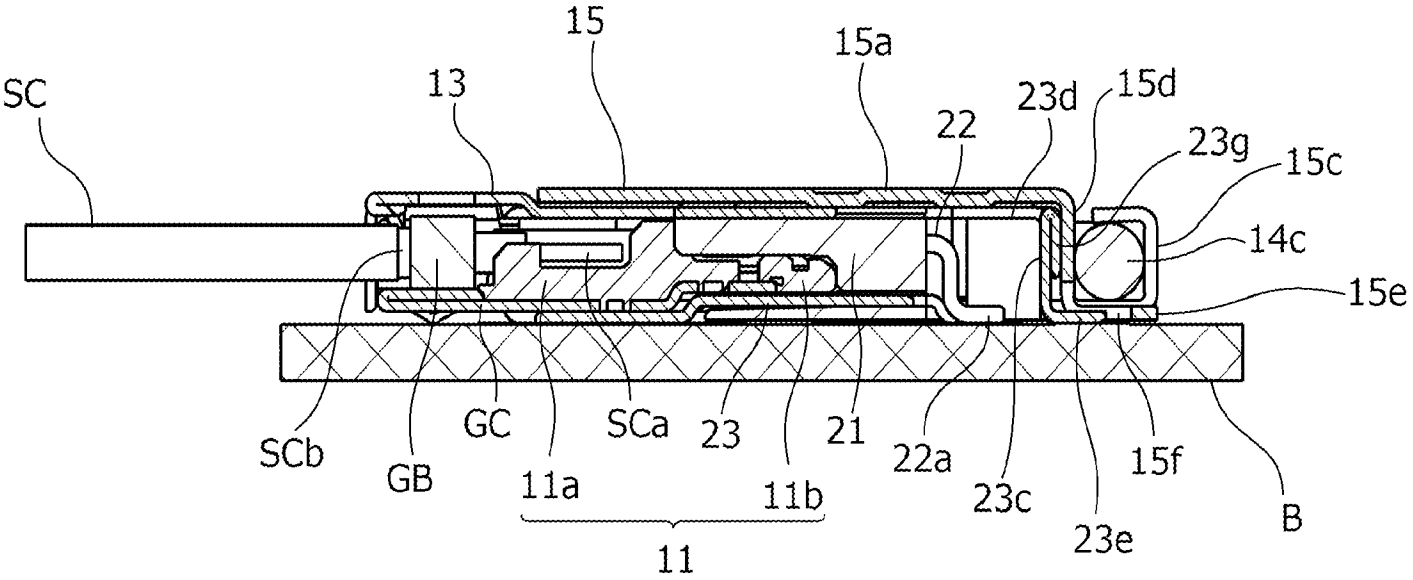
FIG. 10 is an explanatory transverse cross-sectional view of the position between the coaxial cables in the electric connector device after mating shown in FIG. 3.

On the other hand, a back-surface-side shield cover 15*d*, which is composed of a band-plate-shaped member extending so as to be along the turning operating part 14*c* of the mating retaining member (mating operating lever) 14, is integrally provided to be continued to a turning-radius outer-side edge part of the above described upper-surface-side shield cover 15*a*. The back-surface-side shield cover 15*d* is extending so as to form a step shape bent approximately at right angle from the turning-radius outer edge part of the upper-surface-side shield cover 15*a*. As shown in FIG. 10, when the mating retaining member 14 is turned to the "shielded position (mating working position)", there is a disposition relation that the back-surface-side shield cover 15*d* is extending toward the lower side from the rear end edge part of the upper-surface-side shield cover 15*a* so that the back-surface-side shield cover 15*d* is overlapped with the fixation shield plate 23*c*, which is provided in the second shield shell member 23 in the receptacle-connector (second connector) 2 side, from the connector rear side.

Herein, a distal-end extension plate 15*e*, which is bent approximately at right angle toward the turning-radius outer side of the mating retaining member (mating operating lever) 14 and extending in a step shape, is extending so as to be integrally provided to be continued to a distal-end-side edge of the above described back-surface-side shield cover 15*d*, in other words, a lower-end-side edge part thereof when the mating retaining member 14 is turned to the "shielded position (mating working position)". The distal-end extension plate 15*e* is formed by a flat-plate-shaped member extending in a band shape along the turning operating part 14*c* of the mating retaining member 14; and, when the mating retaining member 14 is turned to the "shielded position (mating working position)" in the above described manner, there is a disposition relation that the distal-end extension plate 15*e* is close to or contacts the surface of the printed wiring board B in an approximately parallel state.

In the distal-end extension plate 15*e*, which is provided to be continued to the back-surface-side shield cover 15*d* in this manner, a plurality of relief holes 15*f*, which are arranged so as to have predetermined intervals in the connector longitudinal direction, are formed to penetrate therethrough. The relief holes 15*f* are formed by through holes having planarly rectangular shapes disposed at the positions facing the ground-connection electrically-conductive paths B1, which are provided on the printed wiring board B in the above described manner, and the relief holes 15*f* are formed partially in the part from the distal-end extension plate 15*e* to the back-surface-side shield cover 15*d*. When the mating retaining member (mating operating lever) 14 is turned to the "shielded position (mating working position)" in the above described manner, the distal-end extension plate 15*e* of the back-surface-side shield cover 15*d* becomes close to or contacts the printed wiring board B; and, at this point, the relief holes 15*f* provided in the distal-end extension plate 15*e* are disposed so as to face the ground-connection electrically-conductive paths B1 so that the upper-back-surface-side shield cover 15*d* is configured not to directly contact the ground-connection electrically-conductive paths B1 and the ground connection parts 23*e*, which are solder-connected to the ground-connection electrically-conductive paths B1, particularly as shown in FIG. 10.

Moreover, at the parts at which the plurality of relief holes 15*f* provided in the above described manner are mutually adjacent in the connector longitudinal direction, elastic spring members 15*g* constituting cover contact-point parts are formed so as to be cut and raised. The plurality of elastic spring members 15*g* as the cover contact-point parts are arranged with predetermined intervals in the connector longitudinal direction and are extending so as to form cantilever shapes from part of the above described distal-end extension plate 15*e* to the back-surface-side shield cover 15*d*. The elastic spring member (cover contact-point part) 15*g* is bent so as to form an approximately "L" shape at an intermediate part in the extending direction of the cantilever shape. In more detail, the part formed in the distal-end extension plate 15*e*, which is a root-side base end part of the elastic spring member 15*g*, is extending in the turning-radius direction of the mating retaining member (mating operating lever) 14 and is bent and extending from an intermediate position of the extending part, and a distal-end-side part of the elastic spring member 15*g*, in other words, the part formed at the back-surface-side shield cover 15*d* is configured to extend along the back-surface-side shield cover 15*d*.

When the mating retaining member 14 is turned to the "shielded position (mating working position)", the plurality of elastic spring members (cover contact-point parts) 15*g*, which are provided in the electrically-conductive cover member 15 in this manner, are configured to be in a disposition relation in which the elastic spring members 15*g* extend toward a connector-front-side oblique upper side, and the elastic spring members (cover contact-point parts) 15*g* of the electrically-conductive cover member 15 elastically contact the shell contact piece 23*g*, which is provided at the upper edge part of the fixation shield plate 23*c* of the above described second shield shell member 23, from the connector rear side and become an electrically connected state. When the elastic spring members 15*g*, which are provided in the electrically-conductive cover member 15 of the plug connector (first connector) 1, is brought into an electrically contacting state as the cover contact-point parts in this manner with respect to the second shield shell member 23 of the receptacle connector (second connector) 2, the ground circuit for shielding is formed well.

As described above, in the present embodiment, the parts excluding the rear end side of the electrically-conductive contact members (second contact members) 22 attached to the receptacle connector (second connector) 2 are in a covered state from the beginning by upper shell plate 23*b*, the holddowns 23*a* and 23*a*, and the fixation shield plate 23*c* of the second shield shell member 23. Furthermore, when the mating retaining member (mating operating lever) 14 is turned from the "unshielded position (mating released position)" to the "shielded position (mating working position)" after the plug connector (first connector) 1 is mated with the receptacle connector (second connector) 2 as the counterpart connector, the electrically-conductive cover member 15 provided at the mating retaining member 14 covers the rear-end-side parts of the electrically-conductive contact members (second contact members) 22, and, as a result, electromagnetic shielding (shield) with respect to the electrically-conductive contact members 22 is carried out well.

Note that, in mutual mating of both of the electric connectors 1 and 2, the terminal electrode parts 12*a* of the electrically-conductive contact members (first contact members) 12 and the contact-point convex parts 22*b* of the electrically-conductive contact members (second contact members) 22 are brought into a connected state; wherein, the connection part is configured to be covered by the second shield shell member 23 of the above described receptacle-connector (second connector) 2 side and the electrically-conductive cover member 15 of the plug-connector (first connector) 1 side from the outer side.

According to the present embodiment provided with such a configuration, first, in the state in which the receptacle connector (second connector) 2 is mounted on the printed wiring board B, the fixation shield plate 23*c*, which is provided in the second shield shell member 23 of the receptacle connector 2, is in a state in which it covers and is opposed to the board connecting leg parts 22*a* of the electrically-conductive contact members (second contact members) 22 from the connector rear side. Then, from such amounted state of the receptacle connector 2, the plug connector (first connector) 1 is mated therewith, and the mating retaining member (mating operating lever) 14 is then subjected to a turning operation from the "unshielded position (mating released position)" to the "shielded position (mating working position)" By virtue of this, the electrically-conductive cover member 15 provided at the mating retaining member 14 of the plug-connector (first connector) 1 side covers the shell opening part 23*d* of the receptacle-connector (second connector) 2 side. As a result, the board connecting leg parts 22*a* of the electrically-conductive contact members 22 are covered by the electrically-conductive cover member 15 also from the perpendicularly upper side of the printed wiring board B, and electromagnetic shielding (shield) with respect to the connection part of the printed wiring board B and the electrically-conductive contact members 22 is carried out well.

Herein, in the present embodiment, the fixation shield plate 23*c* is connected to the ground-connection electrically-conductive paths B1, which are disposed in the vicinities of the board connecting leg parts 22*a* of the electrically-conducive contact members (second contact members) 22, via the ground connection parts 23*e*. Therefore, ground connections are established at the positions in the vicinities of the part where electromagnetic shielding (shield) is carried out, and good electromagnetic shielding characteristics are obtained.

Furthermore, in the present embodiment, until the electrically-conductive cover member 15, which is provided at the mating retaining member (mating operating lever) 14, carries out a turning operation toward the "shielded position (mating working position)" to cover the shell opening part 23*d*, the connection parts of the printed wiring board B and the electrically-conductive contact members 22 are exposed to the outer side through the shell opening part 23*d*. Therefore, the connection state at the connection parts can be checked well from the upper side, for example, by visual.

Furthermore, when the mating retaining member (mating operating lever) 14 is subjected to a turning operation from the "unshielded position (mating released position)" to the "shielded position (mating working position)" after both of the electric connectors 1 and 2 are mutually mated, the mutually mated state of both of the electric connectors 1 and 2 are maintained well. At the same time as that, the gripping force of the mating retaining member 14 causes the electrically-conductive cover member 15 and the second shield shell member 23, which carryout electromagnetic shielding, to be in a pressure-contacted state, and the electric connection state thereof is maintained well. Therefore, the ground connection for carrying out electromagnetic shielding (shield) is reliably and firmly carried out, and electromagnetic shielding (shield) characteristics are further improved.

In addition, in the present embodiment, when the mating retaining member (mating operating lever) 14 is subjected to a turning operation from the "unshielded position (mating released position)" to the "shielded position (mating working position)", the electrically-conductive cover member 15 of the plug connector (first connector) 1 contacts the fixation shield plate 23*c* of the receptacle connector (second connector) 2 well via the elastic spring members (cover contact-point parts) 15*g*, which are provided in the electrically-conductive cover member 15. Therefore, the electromagnetic shielding (shield) characteristics are configured to be further improved.

Furthermore, in the present embodiment, the mating retaining member (mating operating lever) 14 is formed so as to form a circular cross section. Therefore, even when the size/height of the electric connector is reduced, the strength of the mating retaining member 14 is sufficiently maintained. As an embodiment that exerts a similar effect, the mating retaining member may be formed by a rod-shaped member which forms a rectangular cross section.

Herein, with respect to the mating retaining member (mating operating lever) 14, the lock parts 23*f*, which retain the mating retaining member 14 at the "shielded position (mating working position)", are provided in the receptacle connector (second connector) 2. Therefore, the mutually mated state of both of the electric connectors 1 and 2 are maintained well by the lock parts 23*f*.

On the other hand, in the present embodiment, the elastic spring members (elastic spring members) 15*g*, which are formed so as to extend in cantilever shapes on the electrically-conductive cover member 15, are bent at intermediate positions of extension and extended, and the contact-point parts provided on the elastic spring members 15*g* are configured to elastically contact the fixation shield plate 23*c* of the second shield shell member 23. Therefore, even when the size/height of the electric connector is reduced, sufficient span lengths of the elastic spring members 15*g* are ensured, and necessary elasticity of the elastic spring members 15*g* can be maintained.

Herein, the fixation shield plate 23*c* of the second shield shell member 23 as the counterpart member with which the elastic spring members (elastic spring members) 15*g* contact are provided with the shell contact piece 23*g*, which is composed of the bent part of the fixation shield plate 23*c*. Therefore, the elastic spring members 15*g* are configured to be in a good contact relation with respect to the shell contact piece 23*g* so that the electric connectivity of the ground circuit is improved.

Hereinabove, the invention accomplished by the present inventors have been described in detail based on the embodiments. However, the present invention is not limited to the above described embodiments, and it goes without saying that various modifications can be made within the range not departing from the gist thereof.

For example, the present invention is not limited to the connectors for coaxial cables like the above described embodiments, but can be similarly applied also to: connectors for insulating cables, electric connectors of a type in which a plurality of coaxial cables and insulating cables are mixed, electric connectors coupled to flexible wiring boards or the like, board-to-board connectors which mutually connect printed boards, etc.

INDUSTRIAL APPLICABILITY

As described above, the present embodiment can be widely applied to various electric connectors which are used in various electric equipment.

What is claimed is:

1. An electric connector device comprising:

a first connector to which a terminal part of a signal transmission medium is coupled; and a second connector mated with the first connector in a mounted state in which the second connector is connected to a wiring board, wherein a mating retaining member provided in the first connector is configured to be subjected to a turning operation so as to cover, from an outer side, an electrically-conductive shell provided in the second connector when both of the first and second connectors are mated with each other, a mated state of mutually mating both of the first and second connectors is retained by the turning operation of the mating retaining member, an electrically-conductive cover member provided at the mating retaining member covers a part of the second connector connected with the wiring board, and the electrically-conductive cover member is provided with a cover contact-point part that becomes a connected state with respect to the electrically-conductive shell of the second connector in the case of the turning operation of the mating retaining member.

2. An electric connector comprising:

a terminal part of a signal transmission medium that is coupled to the electric connector;

a mating retaining member that is configured to be subjected to a turning operation so as to cover, from an outer side, an electrically-conductive shell provided in a counterpart connector when the connector is mated with the counterpart connector mounted on a wiring board in a connected state, wherein a mated state of mutually mating the electronic connector with the counterpart connector is retained by the turning operation of the mating retaining member;

an electrically-conductive cover member provided at the mating retaining member covers a part of the counterpart connector connected with the wiring board; and the electrically-conductive cover member is provided with a cover contact-point part that becomes a contacted state with respect to the electrically-conductive shell of the counterpart connector in the case of the turning operation of the mating retaining member.

3. The electric connector device according to claim 1, wherein the electrically-conductive cover member and the mating retaining member are composed of mutually different members; and the electrically-conductive cover member is coupled to the mating retaining member via a mechanical fixation plates.

4. The electric connector device according to claim 3, wherein the mating retaining member is formed by a rod-shaped member having a circular cross section or a rectangular cross section.

5. The electric connector device according to claim 3, wherein the mechanical fixation plates include a swage fixation piece disposed to be opposed so as to sandwich the mating retaining member.

6. The electric connector device according to claim 1, wherein the cover contact-point part is configured to be pressure-contacted with the electrically-conductive shell of the second connector by pressing force of the mating retaining member.

7. The electric connector device according to claim 1, wherein the electrically-conductive cover member is provided with a distal-end extension plate extended so as to be close to or contact the wiring board in the case of the turning operation of the mating retaining member and a plurality of elastic spring members extending in a cantilever shape from the distal-end extension plate;

the plurality of elastic spring members are formed so as to be bent at an intermediate position of a part extending in a cantilever shape and extended; and the cover contact-point part is formed at an extending-direction distal end part of the plurality of elastic spring members.

8. The electric connector device according to claim 7, wherein a shell contact piece that contacts the contact-point part of the plurality of elastic spring members is formed on the electrically-conductive shell of the second connector; and the shell contact piece is formed so as to have a shape extending so as to rise from the wiring board and then bent back toward the wiring board.

9. The electric connector device according to claim 8, wherein the plurality of elastic spring members are disposed to form a row, and the shell contact piece is continuously extending along an arrangement direction of the plurality of elastic spring members.

10. The electric connector according to claim 2, wherein the electrically-conductive cover member and the mating retaining member are composed of mutually different members; and the electrically-conductive cover member is coupled to the mating retaining member via a mechanical fixation plates.

11. The electric connector according to claim 10, wherein the mating retaining member is formed by a rod-shaped member having a circular cross section or a rectangular cross section.

12. The electric connector according to claim 10, wherein the mechanical fixation plates include a swage fixation piece disposed to be opposed so as to sandwich the mating retaining member.

13. The electric connector according to claim 2, wherein the cover contact-point part is configured to be pressure-contacted with the electrically-conductive shell of the counterpart connector by pressing force of the mating retaining member.

14. The electric connector according to claim 2, wherein the electrically-conductive cover member is provided with a distal-end extension plate extended so as to be close to or contact the wiring board in the case of the turning operation of the mating retaining member and a plurality of elastic spring members extending in a cantilever shape from the distal-end extension plate;

the plurality of elastic spring members are formed so as to be bent at an intermediate position of a part extending in a cantilever shape and extended; and the cover contact-point part is formed at an extending-direction distal end part of the plurality of elastic spring members.

15. The electric connector according to claim 14, wherein a shell contact piece that contacts the contact-point part of the plurality of elastic spring members is formed on the electrically-conductive shell of the counterpart connector; and the shell contact piece is formed so as to have a shape extending so as to rise from the wiring board and then bent back toward the wiring board.

16. The electric connector according to claim 15, wherein the plurality of elastic spring members are disposed to form a row, and the shell contact piece is continuously extending along an arrangement direction of the plurality of elastic spring members.

* * * * *